US010865549B2

(12) United States Patent
Wenger et al.

(10) Patent No.: US 10,865,549 B2
(45) Date of Patent: Dec. 15, 2020

(54) HYDRANT DRAINING

(71) Applicant: VONROLL INFRATEC (INVESTMENT) AG, Zug (CH)

(72) Inventors: Sascha Wenger, Oensingen (CH); Andreas Schütz, Oberentfelden (CH)

(73) Assignee: VONROLL INFRATEC (INVESTMENT) AG, Zug (CH)

( * ) Notice: Subject to any disclaimer, the term of this patent is extended or adjusted under 35 U.S.C. 154(b) by 37 days.

(21) Appl. No.: 16/094,554

(22) PCT Filed: Feb. 16, 2016

(86) PCT No.: PCT/EP2016/053234
§ 371 (c)(1),
(2) Date: Oct. 18, 2018

(87) PCT Pub. No.: WO2017/140346
PCT Pub. Date: Aug. 24, 2017

(65) Prior Publication Data
US 2019/0119887 A1 Apr. 25, 2019

(51) Int. Cl.
*E03B 9/14* (2006.01)
*E03B 9/04* (2006.01)

(52) U.S. Cl.
CPC . *E03B 9/14* (2013.01); *E03B 9/04* (2013.01)

(58) Field of Classification Search
CPC ..... E03B 9/04; E03B 9/14; Y10T 137/5386; Y10T 137/5327
See application file for complete search history.

(56) References Cited

U.S. PATENT DOCUMENTS 1,433,110 A * 10/1922 Buckler ..... E03B 9/14 137/107
2,020,071 A * 11/1935 Lofton ..... E03B 9/14 137/289

(Continued)

FOREIGN PATENT DOCUMENTS

DE 216 870 12/1909
EP 2 781 663 9/2017

OTHER PUBLICATIONS

International Search Report and Written Opinion for PCT/EP2016/053234 filed Feb. 16, 2016.

(Continued)

*Primary Examiner* — Kevin R Barss
(74) *Attorney, Agent, or Firm* — Notaro, Michalos & Zaccaria P.C.

(57) ABSTRACT

A hydrant has a riser pipe and a shut-off element which can be brought from at least one open position into at least one closed position and vice versa. The shut-off element in the closed position seals the interior of the riser pipe from a hydrant inlet. The hydrant comprises at least one first passage, by which the interior can be fluidically connected to the outside of the hydrant, and one second passage, by which the pressurized hydrant inlet can be fluidically connected to the outside of the hydrant, wherein the first passage and the second passage can be brought into operative connection with each other. The operative connection produces a vacuum by water flowing through the second passage such that water in the interior of the riser pipe is led away via the first passage and the riser pipe is thereby drained.

30 Claims, 7 Drawing Sheets

(56) References Cited

U.S. PATENT DOCUMENTS

| | | | | | |
|---|---|---|---|---|---|
| 2,481,909 | A | | 9/1949 | Dales | |
| 3,980,097 | A | * | 9/1976 | Ellis | E03B 9/14 137/283 |
| 4,520,836 | A | * | 6/1985 | Hutter, III | E03B 7/12 137/282 |
| 4,653,521 | A | * | 3/1987 | Fillman | E03B 9/04 137/1 |
| 6,085,776 | A | * | 7/2000 | Hoeptner, III | E03B 9/14 137/281 |

OTHER PUBLICATIONS

International Preliminary Report on Patentability for PCT/EP2016/053234 filed Feb. 16, 2016.

* cited by examiner

HYDRANT DRAINING

This present invention relates to a hydrant. Hydrants are connected to a water distribution system and represent a water-dispensing fitting to enable the fire brigade as well as public and private users to withdraw water from the public water distribution system. The mains pressure in the water distribution system is typically approx. 6 to 9 bar. Hydrants are generally differentiated between surface hydrants and underground hydrants. The surface hydrant is permanently installed above ground and has outlets with standardized couplings. The underground hydrant is installed underground and covered by a ground cover from above. Thus, the underground hydrant is a water withdrawal point located below ground level, which is closed off by the ground cover. Hydrants comprise a riser pipe with an interior and an exterior, with the interior opening into the connection for water extraction. To open and close hydrants, they are equipped with a shut-off device located in the area of a bottom-side inlet pipe. As long as the shut-off element is in the closed position, the interior of the riser pipe is sealed against frost from the hydrant inlet.

To open or close the shut-off element, a spindle, which is arranged essentially axially in the hydrant, is turned over manually. By turning the spindle, this rotation is transferred to a spindle nut, whereby the section of the spindle running axially in the hydrant, also called valve rod, is guided axially up and down. The shut-off element is arranged below the so-called frost line, so that the water does not freeze. In the state of the art, measures are known which, after closing the shut-off element, concern the drainage of water from the interior of the riser pipe so that the interior of the riser pipe is free of water which could otherwise freeze in it. The drainage of water from the interior of the riser pipe should prevent damage to the hydrant caused by freezing water. Draining the water from the interior of the riser pipe also serves to reduce corrosion inside the hydrant and to prevent the formation of germs in the stale water. Slide hydrants are also known, in which the shut-off device comprises a slide and sealing surfaces interacting with it, into which the slide is pushed for shut-off.

The printed publication U.S. Pat. No. 3,858,599 discloses a hydrant with a drain device for draining water from the riser pipe of the hydrant after the shut-off element has closed. The disclosed drain device comprises a drain pipe located in the riser pipe and above the shut-off element, which, after the shut-off element has closed, connects the interior of the riser pipe to its outside and opens into a gravel bed. This should allow the water to be drained off with a reduced risk of clogging.

In the state of the art, one problem is that drainage systems for draining the interior of the riser pipe can become clogged and therefore only insufficient drainage takes place. The blockages may be due to a blockage of the outlet of the respective drainage pipes, for example by compacting the soil in the section of the outlet of the drainage pipe. There is also a risk that the drainage pipe will freeze up completely or at least partially if, for example, it is not properly laid below the frost line. It is also disadvantageous that it is not always ensured that the soil in the area of the riser pipe of the hydrant has the necessary permeability to reliably drain off the required amount of water from the riser pipe. In the state of the art, the water flows out of the riser pipe only through the pressure of the water column in the interior. Another problem in the state of the art is that at a high groundwater level there is an unwanted return flow of water from the ground into the interior of the riser pipe, thereby filling the riser pipe with impure water. A high groundwater level can be found near lakes, rivers or water bodies in general. The groundwater level can rise, for example, due to heavy rainfall. In addition to the aforementioned danger of water freezing, there is thus a further danger of germ formation in the interior of the hydrant. This can cause germs to come into contact with fresh water from the water distribution network. When the hydrant is used, germ-contaminated water is ejected, which can endanger the health of humans and animals. It is therefore the object of the present invention to propose a hydrant whose riser pipe can be reliably drained.

This object is achieved by a hydrant according to the independent claim 1. Other advantageous features result from the dependent claims.

According to the invention, the aforementioned object is achieved by a hydrant which comprises a riser pipe with an interior and an exterior and a shut-off element which can be brought from at least one open position into at least one closed position and vice versa, and wherein the shut-off element is designed in the closed position such that the interior of the riser pipe can be sealed against a hydrant inlet. The hydrant further comprises at least one first passage through which the interior of the riser pipe can be fluidly connected to the exterior of the hydrant, and one second passage through which the pressurized hydrant inlet can be fluidly connected to the exterior of the hydrant, wherein the first and second passages can be brought into operative connection with one another, wherein this operative connection generates a vacuum by means of water flowing through the second passage, so that water present in the interior of the riser pipe is discharged via the first passage and the riser pipe is thereby drained.

Advantages of the present invention comprise:

The water inside the riser pipe is reliably ejected from the hydrant inlet by means of the Venturi principle through the pressurized water. This ensures that the riser pipe is reliably emptied by means of a strong vacuum.

The construction is particularly simple and does not require complex components, so that the drainage of the riser pipe is highly reliable.

The drainage of water from the interior of the riser pipe takes place particularly quickly.

After drainage of the riser pipe, the passages can be closed. This prevents water from the ground from flowing back into the interior of the riser pipe. Thus, the interior of the riser pipe is not contaminated with contaminated water.

Drainage is carried out by means of a generated strong vacuum, so that drainage is possible even when the groundwater level is higher than the water level in the interior of the riser pipe.

The jet pump is integrated in the hydrant. This eliminates the need for cumbersome and lengthy work to lay drainage pipes and possibly other external components. No further extensions are necessary.

The drainage system of the hydrant is particularly easy to operate.

The drainage system can be retrofitted to many types of hydrants. Furthermore, the drainage device can be used with almost all types of shut-off elements.

Hydrants already installed in the field can be retrofitted with the drainage device of the hydrant according to the invention.

Drainage can be accelerated by providing several jet pumps to a drainage device in the lower part of the riser pipe. The jet pumps can be arranged at a certain angular distance from each other.

Drainage can be controlled manually or electrically, e.g. with the aid of an actuator. The actuator can include an electrically or mechanically controllable valve. This allows the passages to be opened and closed particularly reliably.

Drainage can be carried out by turning a hydrant valve rod, which is normally used to open and close the shut-off element, to a predetermined rotary position.

The hydrant according to the invention is explained in more detail by means of exemplary embodiments and corresponding drawings, which are not intended to limit the scope of the present invention, wherein:

FIGS. 1*a-c* show a sectional view of a section of a shut-off element from a hydrant in different valve positions according to a first variant of a first embodiment;

Figures 4A, 4B, 4C:
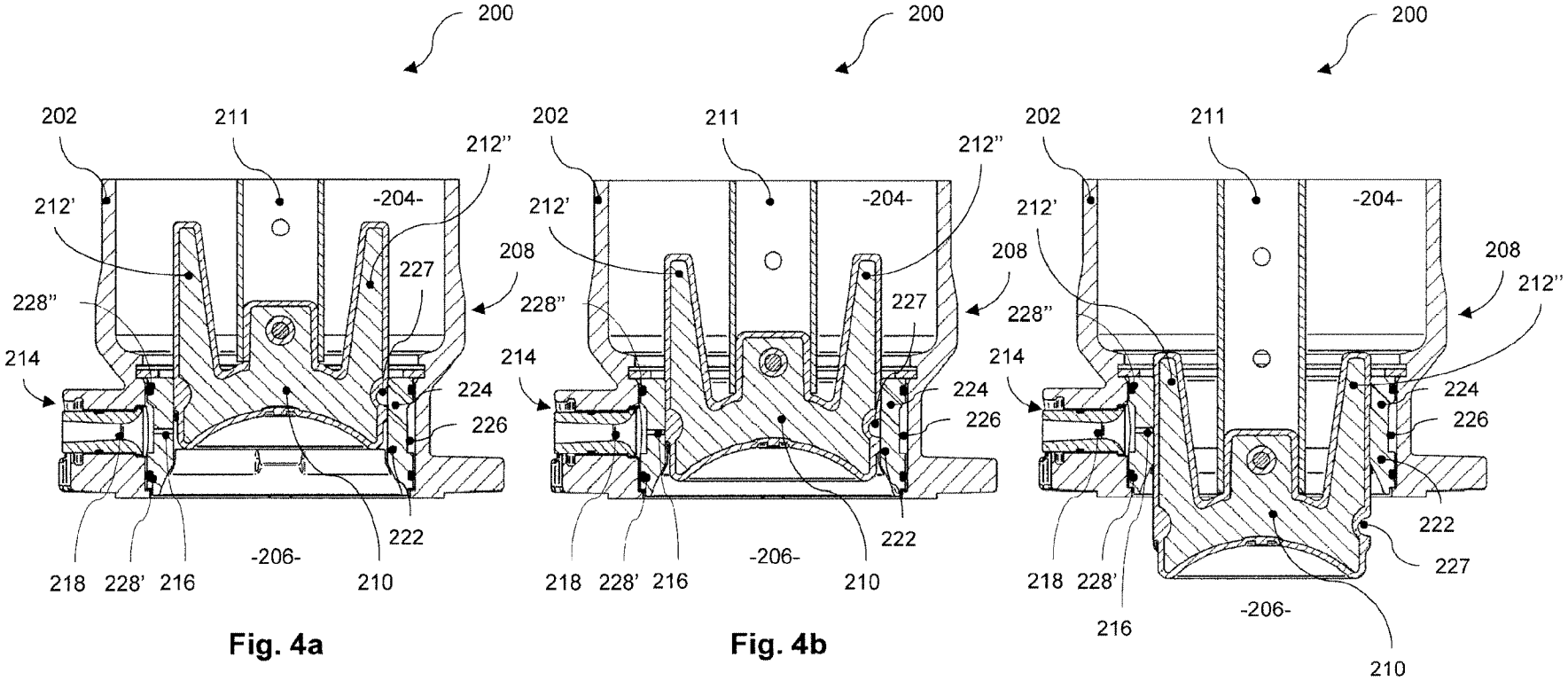
Figures 5A, 5B, 5C:
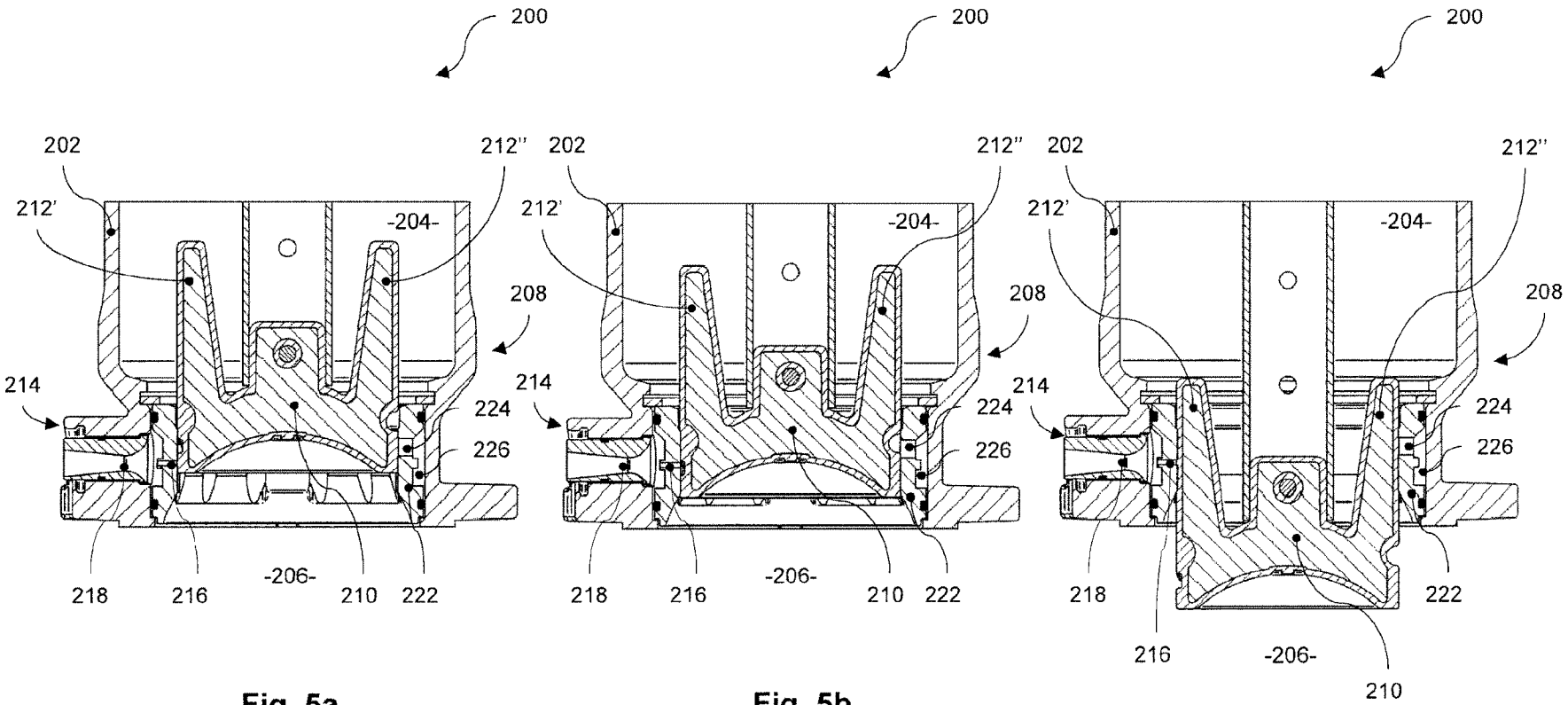
Figures 6A, 6B, 6C, 6D:
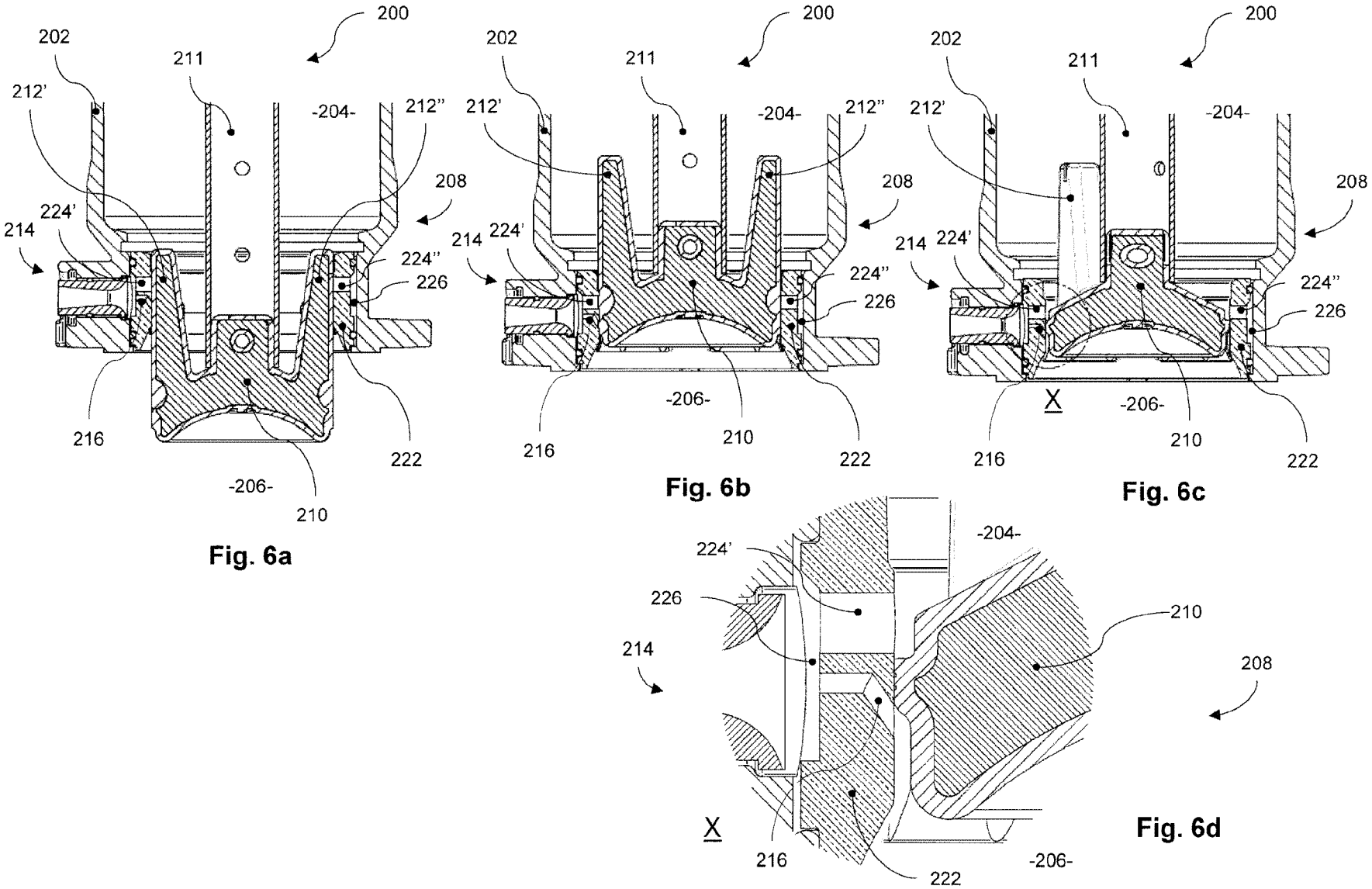
Figure 7C:
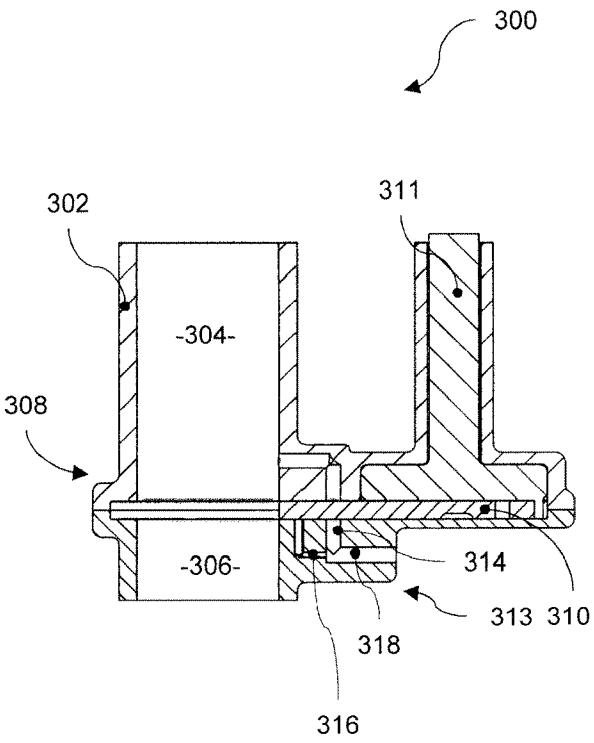
Figure 7B:
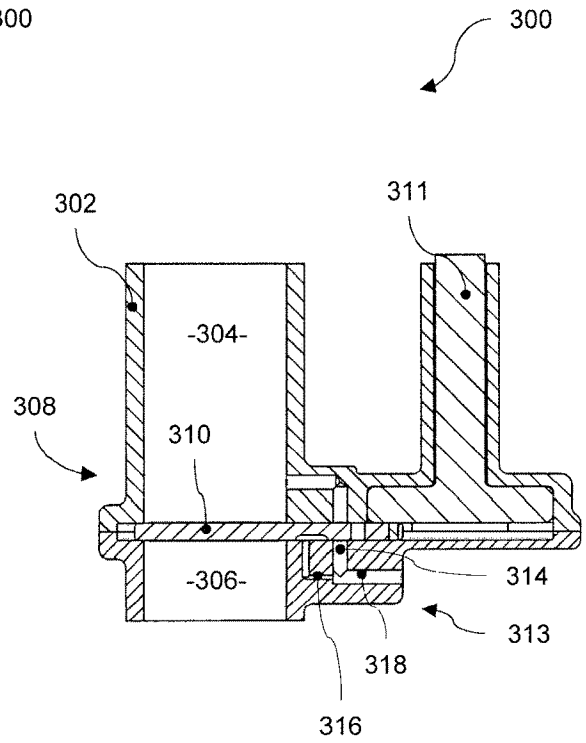
Figure 7A:
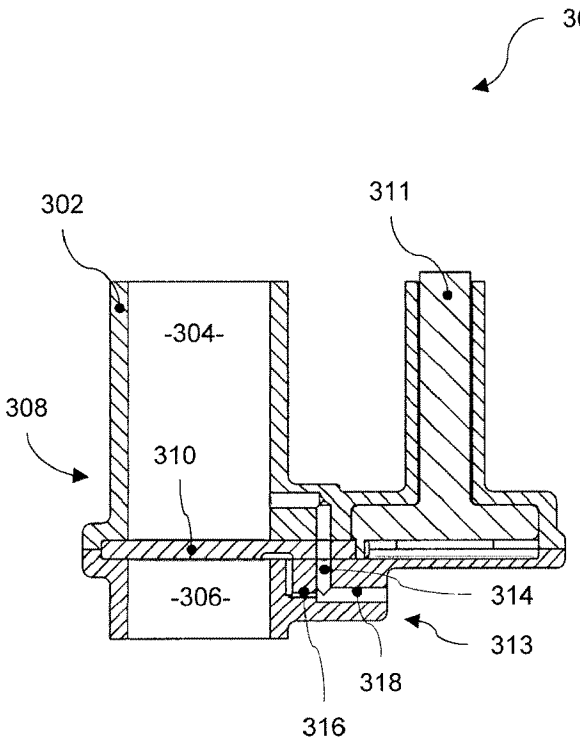

FIGS. 4*a-c* show a sectional view of a section of a shut-off element from a hydrant in different valve positions according to a first variant of a second embodiment;

FIGS. 5*a-c* show a sectional view of a section of a shut-off element from a hydrant in different valve positions according to a second variant of the second embodiment;

FIGS. 6*a-d* show a sectional view of a section of a shut-off element from a hydrant in different valve positions according to a third variant of the second embodiment; and FIGS. 7*a-c* show a sectional view of a section of a shut-off element from a slide hydrant in different slide positions according to a third embodiment.

Preferred embodiments of the hydrants according to the invention are described in detail below.

Figures 1A, 1B, 1C:
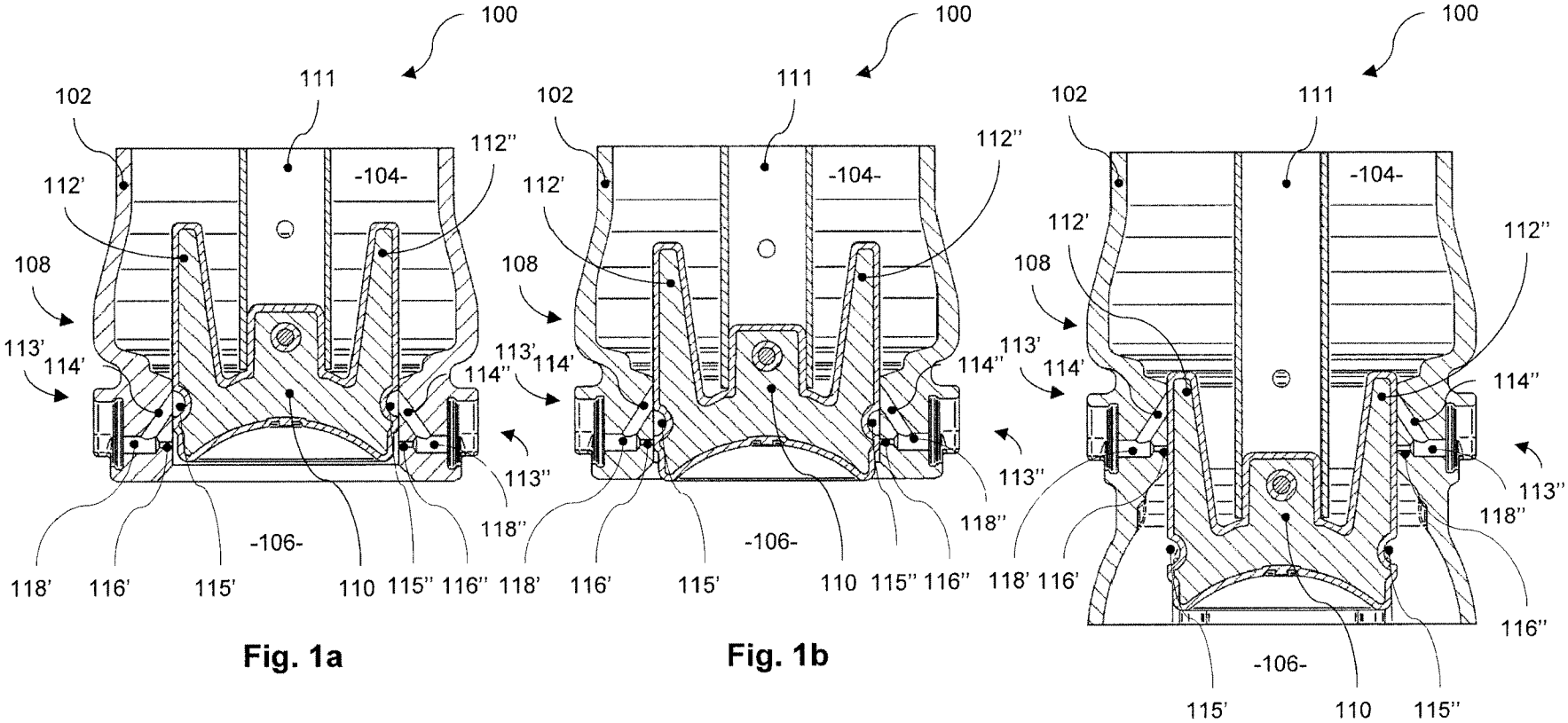

FIGS. 1*a-c* each show a sectional view of a hydrant 100 in different valve positions according to a first variant of a first embodiment. The hydrant 100 includes a riser pipe 102 with an interior 104, and the riser pipe 102 opens into at least one outlet (not shown) for discharging water. When the hydrant 100 is open, the water from a hydrant inlet 106 is transferred under pressure into the interior 104 of the riser pipe 102. To open and close the hydrant 100, the hydrant 100 comprises a shut-off element 108 which can be moved from at least one open position (see FIG. 1*c*) to at least one closed position (see FIG. 1*b*) and vice versa. In the closed position, the shut-off element 108 is designed to seal the interior 104 of the riser pipe 102 against the hydrant inlet 106 in a fluid-tight manner.

Shut-off element 108 comprises a main valve body 110 and at least one component of hydrant 100 having a sealing surface and cooperating therewith for shut-off. Shut-off element 108 is generally a valve with the main valve body 110, which can be brought into contact with the sealing surfaces of hydrant 100. The main valve body 110 can be moved axially in relation to the other interacting components of the shut-off element 108 by means of an axially arranged drive device 111, which is designed as a valve rod, for example. To close the hydrant 100, the main valve body 110 is transferred to the upper valve position shown in FIG. 1*b*, in which the shut-off element 108 is closed, by means of the drive device 111. To open shut-off element 108, the main valve body 110 is moved downwards as shown in FIG. 1*c*. In this position, the water flows under pressure from the hydrant inlet 106 into the riser pipe 102 via peripheral sections of the main valve body 110 which are exposed at least in sections. For guiding the main valve body 110, it is provided with lateral valve wings 112', 112", which are arranged on the main valve body 110 for axial guidance of the main valve body 110 in relation to static sections (also referred to as the main valve seat) of the shut-off element 108 and can be brought into contact with internal surface sections of the shut-off element 108 of the hydrant 100 at least in the open position (see FIG. 1*c*).

For a more detailed explanation of the drainage of hydrant 100 according to the invention, reference is now made to FIG. 1*a*. The previously mentioned term "draining a hydrant" here means that the water in the interior 104 of the riser pipe 102 is discharged to the outside. According to the invention, the water is extracted from the riser pipe 102 by means of a vacuum with the aid of water under pressure from the hydrant inlet 106 and discharged or ejected to the outside. In other words, the first and second passages can be connected to each other in such a way that the energy (pressure) of the water flowing through the second passage expels the water inside the riser pipe to the outside of the hydrant via the first passage. Thus, the riser pipe is reliably drained without any additional energy input (e.g. electrical, hydraulic). Drainage is advantageously achieved only by means of the pressure of the medium (water) conveyed in the water distribution system. The mains pressure in the water distribution system is typically approx. 6 to 9 bar.

For this purpose, the hydrant 100 comprises a first passage 114', 114", via which a fluid connection can be produced between the interior 104 of the riser pipe 102 and the outside of the hydrant 100. As shown in FIG. 1*a* and with reference to FIGS. 1*b,c*, the first passage 114', 114" in the drainage position of the shut-off element 108 faces an opening region 115', 115" on the circumference of the main valve body 110, wherein again a fluid connection via the opening region 115', 115" is communicated with the interior 104 of the riser pipe 102. In the other valve positions of the shut-off element 108, namely in the closed position and in the open position, the first passage 114', 114" is sealed by peripheral sections or the wall of the main valve body 110. More precisely, the first passage 114', 114" in the closed position of hydrant 100 can be sealed through the wall or sealing surfaces of the valve wings 112', 112". In other words, in addition to their function of guiding the main valve body 110, the valve wings 112', 112" are also designed to close or open at least the first passage 114', 114" by means of their sealing surface. Thus, the first passage 114', 114" is only connected to the interior 104 in the drainage position shown in FIG. 1*a* via the opening region 115', 115".

To discharge the water from the interior 104 of the riser pipe 102, a second outlet 116', 116" is also in fluid connection with the hydrant inlet 106, also only in the drainage position shown in FIG. 1*a*. The second passage 116', 116" leads to the outside. In other words, in the drainage position of the shut-off element 108, the pressurized water can be ejected from the hydrant inlet 106 to the outside of the hydrant 100 via the second outlet 116', 116". The first passage 114', 114" opens into a section connected to the second passage 116', 116". The water discharged through the first passage 114', 114" from the riser pipe 102 meets the water discharged under pressure to the outside via the second passage 116', 116" from the hydrant inlet 106. At least the first passage 114', 114" and second passage 116', 116" thus form the jet pump 113', 113", which drains the water from the interior 104 of the riser pipe 102 to the outside.

In the following reference is made in detail to the jet pump 113', 113". The jet pump 113', 113" comprises a vacuum chamber 118', 118" which connects to the second outlet 116', 116" and leads outwards. The vacuum chamber 118', 118"

can be subjected to negative pressure by the water flowing out of the hydrant inlet 106 via the second outlet 116', 116" under pressure (jet pump principle or Venturi principle). The vacuum chamber 118', 118", which is subjected to a negative pressure, is in fluid connection with the interior 104 of the riser pipe 102 via the first passage 114', 114". Thus, the water is reliably sucked out of the interior 104 of the riser pipe 102 by means of generated vacuum and discharged to the outside.

In the open position of the hydrant 100 shown in FIG. 1*c*, the first passage 114', 114" and the second passage 116', 116" are sealed through the wall or sealing surfaces of the valve wings 112', 112". In other words, the valve wings 112', 112" are designed to close or open at least the first passage 114', 114" and second passage 116', 116" by means of their sealing surface.

At the inlet of the jet pump 113', 113", a water jet flows under full line pressure from the hydrant inlet 106 via the second passage 116', 116" into the vacuum chamber 118', 118". The vacuum chamber 118', 118" has a larger diameter than the second passage 116', 116". Between the fast flowing water jet and the surrounding water from the riser pipe 102 a mixing of the media occurs, whereby kinetic energy from the water jet from the hydrant inlet 106 is transferred to the surrounding water from the riser pipe 102 and thus a conveying mechanism is provided. The ejection of the medium creates a vacuum in the vacuum chamber 118', 118", whereby the water to be pumped from the riser pipe 102 flows in through the vacuum connection.

By means of a surprisingly simple solution, the water from the interior 104 of the riser pipe 102 is ejected to the outside by the pressurized water from the hydrant inlet 106 via the jet pump principle or Venturi principle. This ensures that the water in the riser pipe 102 is discharged to the outside particularly quickly and reliably. In the first variant of the first embodiment shown in the FIGS. 1*a-c*, two jet pumps 113', 113" are shown. This almost halves the time required to discharge the water from the riser pipe 102 in relation to an example in which only one jet pump is provided. Of course, although not shown in FIGS. 1*a-c*, only one jet pump can be provided on hydrant 100. Of course, three or more jet pumps can also be provided on hydrant 100 (not shown).

In the drainage position shown in FIG. 1*a*, the hydrant 100 is closed, i.e. the direct fluid connection between the hydrant inlet 106 and the interior 104 of the riser pipe 102 is blocked. To transfer the hydrant 100 from the drainage position shown in FIG. 1*a* to the fully closed valve position or closed position shown in FIG. 1*b*, the main valve body 110 is moved axially downwards by means of the drive device 111 (valve rod). As explained above, the first passage 114', 114" is sealed in this case fluid-tight against the interior 104 of the riser pipe 102 by circumferential sections of the valve wings 112', 112". At the same time, the second passage 116', 116" is sealed fluid-tight against the hydrant inlet 106 by peripheral sections of the main valve body 110. After drainage of the riser pipe 102, the hydrant 100 is advantageously transferred from the drainage position to the closed valve position or the closed position of the shut-off element 108.

In the first variant of the first embodiment shown in FIGS. 1*a-c*, shut-off element 108 comprises a hydrant main valve, which is formed here by sections of hydrant 100 itself (also referred to as main valve seat or sealing surfaces of the hydrant) and the main valve body 110. The said sections of hydrant 100 may at least be related to: first passage 114', 114", second passage 116', 116", jet pump 113', 113", vacuum chamber 118', 118", but not limited thereto.

As mentioned above, the jet pump 113', 113" is designed to discharge the water from the interior 104 of the 102 riser pipe by direct admission through the water supplied at the hydrant inlet 106 to the outside. In the first variant of the first embodiment, an actuator is provided which only establishes a fluid connection between the interior 104 of the riser pipe 102 and the outside of hydrant 100 and between the hydrant inlet 106 and the outside of hydrant 100 in the drainage position. In the first variant of the first embodiment shown in FIGS. 1*a-c*, this actuator is contained in shut-off element 108 or main valve body 110 and the hydrant 100 itself. Therefore no further components are necessary for opening and closing and the embodiment proves to be particularly simple and reliable. Costs are also saved.

In the exemplary embodiment described above, the jet pump 113', 113" is designed to discharge the water from the interior 104 of the riser pipe 102 to the outside by means of direct admission through the water supplied from the hydrant inlet 106.

Although not shown, the riser pipe 102 of hydrant 100 described as an example in the embodiment described (and also in the further embodiments described) may include a ventilation opening (not shown) which compensates for a pressure difference between the interior 104 of the riser pipe 102 and the outside of the hydrant 100 when the riser pipe 102 is drained. This prevents a vacuum in the interior 104 of the riser pipe 102, which counteracts the ejection of water to the outside of the hydrant 100. The hydrant may also include an indicator device (not shown) to provide the operator with an indication of the water level in the interior 104 of the 102 riser pipe. For example, the indicator device may be operatively connected to the ventilation opening and comprise at least one oscillating body which generates an audible oscillation when air flows over and/or through it. When the riser pipe 102 is drained, a vacuum is created which is compensated by the ventilation opening. Air flows in from outside into the interior 104 of the riser pipe 102. The vacuum is generally generated in the drainage position of hydrant 100. In the drainage position of hydrant 100, the vacuum can be generated even if the riser pipe 102 has already been drained. The air flow can excite the oscillating body contained in the indicator device to an audible oscillation. As long as the oscillating body generates an audible vibration, the operator is informed that the hydrant 100 is (still) in the drainage position. This at least reminds the operator to transfer the hydrant 100 to the closed position (FIG. 1*b*) after the drainage position (FIG. 1*a*). As soon as the audible oscillation stops, the operator is simply informed that the hydrant 100 is closed (closed position, see FIG. 1*b*).

Figure 2:
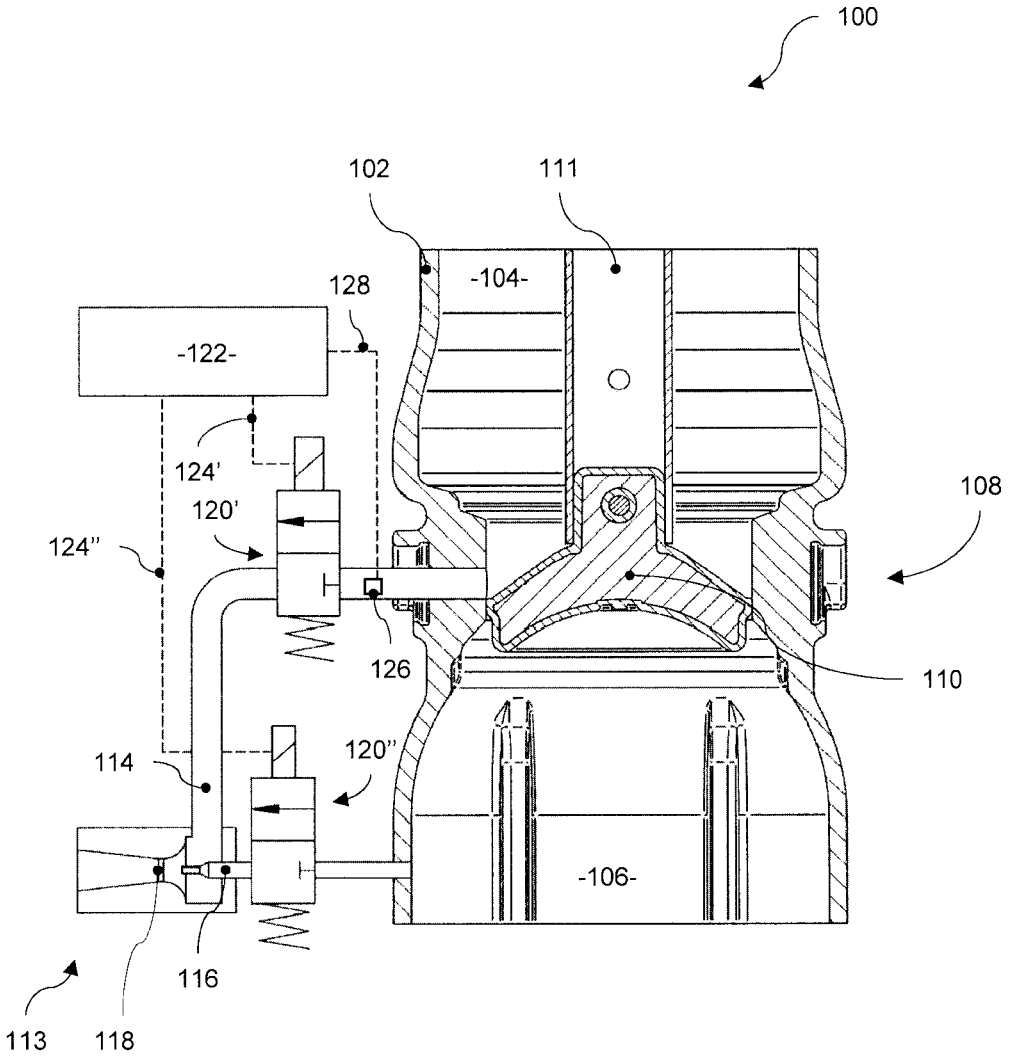
FIG. 2 shows a sectional view of a section of a shut-off element of a hydrant according to a second variant of the first embodiment.

FIG. 2 shows a sectional view of the hydrant 100 in a second variant of the first embodiment. Identical or equal-acting components in relation to the first variant of the first embodiment are marked with identical reference numerals. The hydrant 100 shown in FIG. 2 also includes the first passage 114, the second passage 116 and the jet pump 113 with the vacuum chamber 118.

The second variant differs from the first variant in terms of the actuator design. Furthermore, only one jet pump 113 is shown here. In the second variant of the first embodiment, the actuator comprises electrically controllable valves 120', 120" which release or block a fluid connection between the interior 104 of the riser pipe 102 and the jet pump 113 as well as a fluid connection between the hydrant inlet 106 and the jet pump 113. More precisely, the first electrically controllable valve 120' either releases or blocks a fluid connection between the riser pipe 102 and the jet pump 113. Furthermore, the second electrically controllable valve 120"

is designed to enable or disable a fluid connection between the hydrant inlet 106 and the jet pump 113. Both electrically controllable valves 120', 120" can be controlled via an electrical control unit 122. The electrically controllable valves 120', 120" are each connected to the electrical control unit 122 via a signal connection 124', 124". The signal connection 124', 124" can be an electrical signal line (cable) or a radio connection (wireless connection).

In the valve position shown in FIG. 2, the hydrant 100 is closed by the main valve body 110, i.e. no water is transferred upwards from the hydrant inlet 106 into the riser pipe 102. In this closed valve position, the two electrically controllable valves 120', 120" can be controlled by the control unit 122 for opening until the riser pipe 102 is emptied (drainage position). After draining the riser pipe 102, the two electrically controllable 120', 120" valves are closed. The control unit 122 can be controlled via a drive device 111 to open the two electrically controllable valves 120', 120" or via separate operation, for example a push button or a cable pull.

As previously mentioned, control unit 122 switches the two electrically controllable valves 120', 120" to their closed position as soon as the riser pipe 102 is drained. The two electrically controllable valves 120', 120" can be actuated essentially simultaneously for opening and closing during the transition to the drainage position. It is advantageous to first block the first passage 114 and then block the second passage 116 when changing from the drainage position to the closed position. In other words, the first valve 120' is controlled first for closing and then the second valve 120" for closing. This prevents water from flowing back towards the interior 104 of the riser pipe 102. The changeover can be controlled via a time control, which can, for example, be included in the control unit 122. In an alternative example, the control unit 122 can control the two electrically controllable valves 120', 120" for closing, as soon as an empty condition of the riser pipe 102 is detected via a float (not shown), which serves as a sensor. In another example, a sensor 126 may be installed in or on the first passage 114, which can establish the fluid connection between the interior 104 of the riser pipe 102 and the jet pump 113, which transmits an indication of the water conveyed to the control unit 122. The sensor 126 is connected for this purpose to the control unit 122 via a signal connection 128. The signal connection 128 can be an electrical signal line or a radio connection. As soon as sensor 124 detects that the first passage 114 is no longer carrying water, as the riser pipe 102 has meanwhile been completely drained, the control unit 122, based on this detected condition, will block the two electrically controllable valves 120', 120".

In an example not shown here, only one electrically controllable valve can be provided which opens or closes the two passages 114, 116 simultaneously or shortly in succession. For example, this valve can also be located in the main valve and close or release at least one corresponding hole in the main valve. Instead of the electrically controllable valves 120', 120" described here, at least one mechanically controllable valve (not shown) can also be provided.

In the second variant of the first embodiment shown in FIG. 2, the shut-off element 108 comprises a hydrant main valve, which is formed here by sections of the hydrant 100 per se (sealing surfaces thereof) and the main valve body 110.

Figure 3:
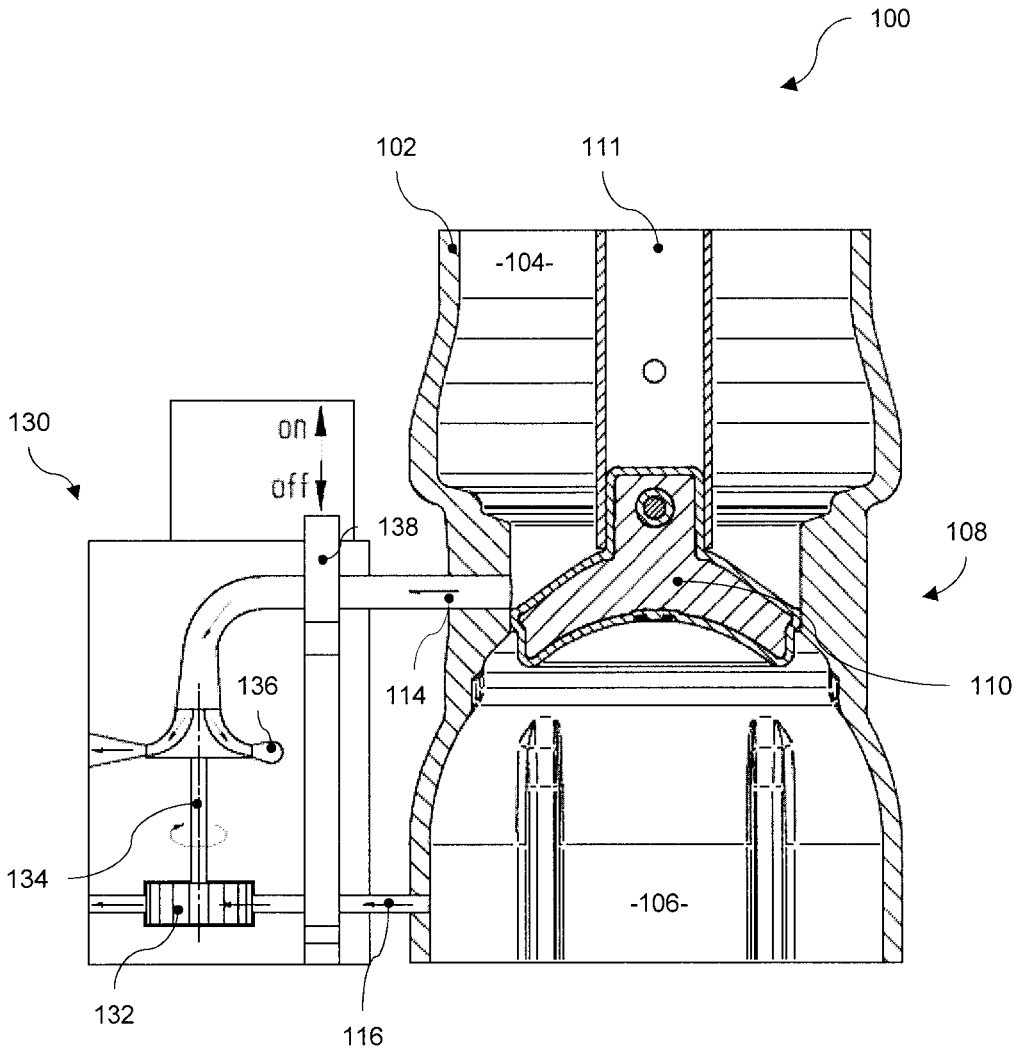
FIG. 3 shows a sectional view of a section of a shut-off element of a hydrant according to a third variant of the first embodiment.

FIG. 3 shows a sectional view of the hydrant 100 in a third variant of the first embodiment. Identical or equal-acting components in relation to the first and/or second variant of the first embodiment are marked with identical reference numerals. The hydrant 100 shown in FIG. 3 also comprises the first passage 114 and the second passage 116, which can be connected in this case to each other by means of a mechanical pump 130 in such a way that the water is discharged outwards from the interior 104 of the riser pipe 102 by indirect action of the water supplied from the hydrant inlet 106. The pump 130 shown in FIG. 3 is a radial centrifugal pump. Pump 130 however can also be designed as an axial or diagonal centrifugal pump (not shown). Alternatively, the mechanical pump 130 can also be designed as a piston pump, diaphragm pump or any type of positive displacement pump.

In the drainage position, a turbine wheel 132 contained in the centrifugal pump 130 is acted upon and reversed by the water flowing under pressure from the hydrant inlet 106. A shaft 134, axially connected to the turbine wheel 132, projects into a vacuum chamber of the centrifugal pump 130 and allows the water flowing in through the first outlet 114 from the riser pipe 102 to flow radially outwards by means of centrifugal force. The water flows in this case into a ring chamber 136 and is discharged thereby to the outside. The first 114 and second 116 passages are opened and closed via a sliding device 138 (valve device) shown schematically. In the variant shown, the first 114 and second 116 passages are blocked via the sliding device 138. By moving the sliding device 138 upwards, the first 114 and second 116 passages are opened. The first 114 and second 116 passages can alternatively be opened and closed via electric valves (not shown).

FIGS. 4*a-c* each show a sectional view of a hydrant 200 in different valve positions according to a first variant of a second embodiment. FIG. 4*b* shows the hydrant 200 with a closed shut-off element 208, in which position one hydrant inlet 206 and one interior 204 of a riser pipe 202 are sealed fluid-tight from each other by a main valve body 210 of the shut-off element 208.

In the illustrated embodiment, the main valve seat of the hydrant 200 is designed as a changeover valve seat 222 which can be inserted into and removed from the hydrant 200. The main valve body 210 can be transferred from at least one open position to at least one closed position and vice versa by means of a drive device 211 in relation to the changeover valve seat 222. In the second embodiment, the drive device 211 is designed as an axially movable valve rod. The changeover valve seat 222 is provided at a portion thereof (shown in FIGS. 4*a-c* on the right side of the changeover valve seat 222) with a first opening 224, with one end thereof opening into a passage space 226. The passage space 226 is designed in the form of a ring around the changeover valve seat 222 and is externally closed by material sections of hydrant 200. In the drainage position, an opening area 227 of the main valve body 210 is located at one end of the first opening 224 opposite the passage space 226. The opening area 227 of the main valve body 210 is again in fluid connection with the interior 204 of the riser pipe 202. For this purpose, the valve wing 212" is provided inside with a valve wing inner conduit (not shown), via which the opening area 227 can be brought into fluid connection with the interior 204 of the riser pipe 202. In the first variant of the second embodiment shown in FIG. 4*a*, the water in the riser pipe 202 therefore flows via the first opening 224 into the passage space 226. In the drainage position of the main valve body 210 in relation to the changeover valve seat 222, the interior 204 of the riser pipe 202 is thus in fluid connection with the passage space 226 through the first opening 224.

The changeover valve seat 222 is of annular design and comprises at least two grooves introduced circumferentially on the outer surface for receiving an annular seal 228', 228" each, which seals the interior 204 of the riser pipe 202, the passage space 226 and the hydrant inlet 206 against each other. The changeover valve seat 222 also includes a second passage 216 through which the hydrant inlet 206 (in the drainage position shown in FIG. 4*a*) can be brought into fluid connection with the passage space 226. Furthermore, the second passage 216 is axially aligned across the passage space 226 to a first passage 214, which comprises a vacuum chamber 218. The second passage 216 is in fluid connection with the outside of hydrant 200 via the first passage 214. Thus, the water flowing out of the hydrant inlet 206 under pressure directly acts on the water in the passage space 226 from the riser pipe 202 and sucks this water out and drains it off towards the outside. The first passage 214 and the second passage 216 each have a circular cross-section. In this case, the second passage 216 has a smaller diameter in relation to the first passage 214.

In the second variant of the second embodiment shown in FIGS. 4*a-c*, the first passage 214 has a circular cross-section with a variable diameter in the longitudinal direction. The diameter in a first section of the first passage 214 tapers in the direction of flow and widens from a second section with a minimum diameter to a third section on the outside. In the second embodiment, the first passage 214 comprises a nozzle that can be inserted into the hydrant body, in particular a Venturi nozzle. The Venturi nozzle can be trumpet-like. The first passage 214 in the illustrated second embodiment has a constricted section which forms the vacuum chamber 218, within which the flow velocity of the water is increased in relation to the other sections of the first passage 214, since the flow velocity is inversely proportional to the pipe cross-section. According to Bernoulli's law, the increase in the flow rate of water is accompanied by a drop in pressure. Due to the resulting pressure drop in the section of the first passage 214 with a minimum cross-section, i.e. the vacuum chamber 218, the water is sucked out of the passage space 226 by means of vacuum and discharged to the outside of the hydrant 200.

Although not shown, the first passage 214 can have an unaltered cylindrical cross-section over its length. It is advantageous if the ratio between the inner diameter of the first passage 214 (or between a minimum inner diameter thereof) and a minimum inner diameter of the second passage 216 is equal to 2:1 to 15:1, in particular 3:1 to 4:1. In one embodiment, the minimum inner diameter of the first passage 214 is 8 mm to 19 mm and the minimum inner diameter of the second passage 216 is 2 mm to 2.5 mm. After the interior 204 of the 202 riser pipe has been drained, the main valve body 210 can be moved axially downwards via the drive device 211 to assume the closed position shown in FIG. 4*b*.

In the closed position shown in FIG. 4*b*, the first opening 224 is sealed at the upstream end by a sealing peripheral section (sealing surface) of the main valve body 210. At the same time, the second passage 216 is sealed by a sealing peripheral section (sealing surface) of the main valve body 210, so that the second passage 216 is sealed against the hydrant inlet 206. At the same time, the hydrant inlet 206 is also sealed against the interior 204 of the riser pipe 202. To draw the water from hydrant 200 from the closed position, the main valve body 210 is moved downwards via drive device 211, namely to such an extent until the water pressurized at hydrant inlet 206 flows upwards through an opening annular gap between the top of the main valve body 210 and the bottom of the changeover valve seat 222, i.e. up into the interior 204 of the riser pipe 202. After the water has been drawn off, the main valve body 210 is transferred from the valve position shown in FIG. 4*c* to the drainage position shown in FIG. 4*a* in order to eject the water accumulated in the riser pipe 202 to the outside of the hydrant 200.

FIGS. 5*a-c* show sectional views of the hydrant 200 in different valve positions according to a second variant of the second embodiment of the invention. This second variant differs from the first variant shown in FIGS. 4*a-c* in that the lower peripheral section of the main valve body 210 in the closed position (FIG. 5*a*) always rests tightly against the inner circumference of the changeover valve seat 222. In contrast to the valve position shown in FIG. 4*a* in the first variant of the second embodiment, no water can flow in the second variant of the second embodiment from the hydrant inlet 206 into the second passage 216 via a directly vertically aligned recess on the main valve body 210, regardless of the valve position.

The main valve body 210 is provided with a main valve body inner conduit (not shown) which establishes a fluid connection between the hydrant inlet 206 and the inlet of the second passage 216 as soon as the main valve body 210 is in the drainage position shown in FIG. 5*b*. In this case, a connection of the main valve body inner conduit overlaps with the inlet of the second passage 216, as shown in FIG. 5*b*. The main valve body inner conduit can be a recess on a peripheral section of the main valve body 210. This recess is not directly vertically aligned (not axial). The pressurized water from the hydrant inlet 206 flows only in this drainage position through the main valve body inner conduit into the second passage 216 and from there into the annular passage space 226 and further into the first passage 214. At the same time, passage space 226 is in fluid connection with the interior 204 of the riser pipe 202 via the first opening 224 and a valve wing inner conduit (not shown).

According to the second variant of the second embodiment, the advantage is that the hydrant 200 can be brought directly into the drainage position by moving the main valve body 210 upwards, starting from the illustration of the hydrant 200 shown in FIG. 5*c* in the open position (open shut-off element 208), as shown in FIG. 5*b*. After draining the riser pipe 202, the main valve body 210 is also moved directly upwards to finally assume the closed position, as shown in FIG. 5*a*. Thus it is advantageously possible to transfer the hydrant 200 from the open position (FIG. 5*c*) via the drainage position (FIG. 5*b*) to the closed position (FIG. 5*a*) and vice versa by means of a unidirectional movement of the main valve body 210.

FIGS. 6*a-c* show sectional views of the hydrant 200 in different valve positions according to a third variant of the second embodiment. FIG. 6*d* shows an enlargement of a section X marked in FIG. 6*c*. In this third variant of the second embodiment, the main valve body 210 can be reversed at least in the drainage position (FIGS. 6*c,d*) by means of an adjusting device 211 in relation to the fixed changeover valve seat 222. The shut-off element 208 is designed to release the flow of water through the first passage 214 and the second passage 216 by reversing the main valve body 210 from the closed position of hydrant 200 (FIG. 6*b*) in relation to the changeover valve seat 222 (FIGS. 6*c,d*).

In the open position of the hydrant 200 shown in FIG. 6*a*, the main valve body 210 is axially displaced downwards by means of the adjusting device 211, so that the water rises from the hydrant inlet 206 under pressure into the interior 204 of the riser pipe 202.

By moving the main valve body 210 upwards from the open position (FIG. 6*a*) to the closed position (FIG. 6*b*), the aforementioned flow of water is shut off and reliably sealed (see FIG. 6*b*). In this closed position of the main valve body 210, the first opening 224', 224" leading to the passage space 226 is sealed by circumferential sections (sealing surface) of the main valve body 210. Furthermore, the second passage 216 is sealed by peripheral sections (sealing surface) of the main valve body 210. In this position the hydrant 200 is reliably closed.

To drain the hydrant 200, the main valve body 210—starting from the closed position (FIG. 6*b*)—is turned over in relation to the changeover valve seat 222 by means of the adjusting device 211. In the embodiment shown here, the adjusting device 211 is designed by the aforementioned valve rod. In other words, the main valve body 210 is turned by means of the adjusting device 211, which also moves the main valve body 210 up and down. Although not shown, other components can be assumed as adjusting devices for turning the main valve body 210.

By turning the main valve body 210 to a predetermined rotary position, passage sections of the main valve body 210 overlap with both the first opening 224', 224" and the second passage 216. For example, the aforementioned passage sections may be one or more recesses embedded in the main valve body 210, through which the pressurized water in the hydrant inlet 206 flows into the second passage 216 and through which the water from the riser pipe 202 flows into the first opening 224', 224".

In the third variant of the second embodiment shown in FIGS. 6*a-d*, the valve wings 212', 212" reach out of the sealing abutment against the first opening 224', 224" (as can be seen particularly clearly in FIG. 6*d*) by turning the main valve body 210 in relation to the rotationally rigidly mounted changeover valve seat 222, so that the water can drain from the interior 204 of the riser pipe 202 through the first opening 224', 224" into the annular passage space 226. Due to the jet pump effect described above, the water is then reliably discharged to the outside by means of the water injected under pressure from the hydrant inlet 206. After drainage, the main valve body 210 is simply turned back to assume the closed position shown in FIG. 6*b*.

A particular advantage of this embodiment is that the main valve body 210 does not require any further axial height adjustment in order to be transferred to the drainage position. The operator can move the main valve body 210 between two maximum valve positions as usual, namely a fully open position (see FIG. 6*a*) and a fully closed position (see FIG. 6*b*). According to the embodiment shown here, no further height adjustment is necessary for drainage, but the main valve body 210 is only twisted at a certain angle in relation to the rotationally rigidly mounted changeover valve seat 222.

Although not shown, in an alternative example the changeover valve seat 222 can be turned over in relation to the main valve body 210 mounted in a torsionally rigid manner. As clearly shown in FIG. 6*d* in particular, the second passage 216 in particular is diverted or offset from the linear (essentially horizontal) course in such a way that the section facing the hydrant inlet 206 is diverted (bent over) downwards. This allows the entrances of the second passage 216 and the first opening 224', which face the hydrant inlet 206, to be spaced apart to some extent. By increasing the distance between the two inlets, the sealing between the two inlets, as clearly shown in FIG. 6*d*, is improved (increased sealing surface).

FIGS. 7*a-c* show a sectional view of a hydrant 300 according to a third embodiment. The hydrant 300 shown in FIGS. 7*a-c* is a slide hydrant. The shut-off element 308 comprises a slide 310, which is pushed into or out of the path between hydrant inlet 306 and interior 304 of a riser pipe 302 via a drive device 311. The shut-off element 308 thus comprises the slide 310 and the cooperating sealing surfaces of the hydrant 300, and the drainage position is shown in the slide position of the hydrant 300 shown in FIG. 7*a*. Here, lines to a jet pump 313 are themselves enabled or blocked via the shut-off element 308.

In the slide position shown in FIG. 7*b*, the hydrant 300 is completely closed. In this closed position, the slide 310 is fully integrated into the path between hydrant inlet 306 and interior 304 of the riser pipe 302. Fluid lines between the jet pump 313 and the interior 304 of the riser pipe 302 and the hydrant inlet 306 are also interrupted.

In the slide position of the hydrant 300 shown in FIG. 7*c*, it is fully open. The pressurized water from the hydrant inlet 306 is thus transferred directly upwards into the interior 304.

As previously mentioned, the hydrant 300, in the slide position shown in FIG. 7*a*, is in the drainage position. In this slide position, the direct fluid connection between the hydrant inlet 306 and the interior 304 of the riser pipe 302 is blocked by slide 310. At the same time, a fluid connection between the hydrant inlet 306 and the jet pump 313 is released via a second passage 316. In the embodiment shown, the fluid connection is released by at least sections of the slide 310 itself. At the same time, a fluid connection between the interior 304 and the jet pump 313 is released via a continuous first passage 314. The water flowing out of the hydrant inlet 306 via the second passage 316 flows into a vacuum chamber 318 of the jet pump 313 and draws in the water from the interior 304 of the riser pipe 302 via the first passage 314 by means of a generated vacuum and discharges it outwards.

The same reference numerals indicate the same or corresponding features of the hydrant according to the invention, although reference is not made thereto in each case and in relation to every figure.

LIST OF REFERENCE NUMERALS

100;200;300 Hydrant
102;202;302 Riser pipe
104;204;304 Interior
106;206;306 Hydrant inlet
108;208;308 Shut-off element
110;210 Main valve body
111;211;311 Drive device
112', 112";212', 212" Valve wing
113, 113', 113";213;313 Jet pump
114, 114', 114"; 214; 314 First passage
116, 116', 116"; 216; 316 Second passage
118, 118', 118"; 218; 318 Vacuum chamber
120', 120" Electrically controllable valve
122 Control unit
124', 124" Signal connection
126 Sensor
128 Signal connection
130 Mechanical pump
132 Turbine wheel
134 Shaft
136 Ring chamber
138 Sliding device
222 Changeover valve seat
224, 224', 224" First opening

226 Passage space
227 Opening area
228', 228" Annular seal
310 Slide

The invention claimed is:

1. A hydrant (100;200;300) comprising:

a riser pipe (102;202;302) having an interior (104;204;304) and an exterior and a shut-off element (108;208;308) configured to be moved from at least one open position to at least one closed position and vice versa, wherein the shut-off element (108;208;308) is adapted in the closed position such that the interior (104;204;304) of the riser pipe (102;202;302) can be sealed against a hydrant inlet (106;206;306), wherein the hydrant (100;200;300) has at least one first passage (114,114',114";214;314), configured to bring the interior (104;204;304) of the riser pipe (102;202;302) into fluid connection with the outside of the hydrant (100;200;300), and a second passage (116,116',116";216;316), configured to bring the pressurized hydrant inlet (106;206;306) into fluid connection with the outside of the hydrant (100;200;300), and wherein the first (114,114',114";214;314) and second (116,116',116";216;316) passage are brought into operative connection with one another, wherein this operative connection generates a vacuum by means of water flowing through the second passage (116,116',116";216;316), so that water present in the interior (104;204;304) of the riser pipe (102;202;302) is discharged via the first passage (114,114',114";214;314) and thereby the riser pipe (102;202;302) is drained.

2. Hydrant (100;200;300) according to claim 1, wherein the first passage (114,114',114";214;314) and the second passage (116,116',116";216;316) are operatively connectable to each other such that the water from the interior (104;204;304) of the riser pipe (102;202;302) is discharged to the outside by direct or indirect admission through the water supplied from the hydrant inlet (106;206;306).

3. Hydrant (100) according to claim 1, wherein the first passage (114) and the second passage (116) are configured to be brought into operative connection with one another via a mechanical pump (130), in particular a centrifugal pump or a positive displacement pump, such that the water is discharged to the outside from the interior (104) of the riser pipe (102) by means of indirect admission through the water supplied from the hydrant inlet (106).

4. Hydrant (100;200;300) according to claim 1, wherein the first passage (114,114',114";214;314) and the second passage (116,116',116";216;316) are configured to be brought into operative connection with one another via a jet pump (113,113',113";213;313) in such a way that the water from the interior (104;204;304) of the riser pipe (102;202;302) is discharged to the outside by direct admission through the water supplied from the hydrant inlet (106;206;306).

5. Hydrant (100;200;300) according to claim 4, wherein in a drainage position of the shut-off element (108;208;308) the first (114,114',114";214;314) and second (116,116',116";216;316) passage are separated in a fluid-tight manner by the shut-off element (108;208;308) and the flow of water through the first (114,114',114";214;314) and second (116,116',116";216;316) passage is enabled.

6. Hydrant (100;200;300) according to claim 4, wherein the jet pump (113,113',113";213;313) comprises a vacuum chamber (118,118',118";218;318) configured be subjected to a vacuum by a water jet flowing from the hydrant inlet (106;206;306) via the second passage (116,116',116";216;316), wherein the vacuum chamber (118,118',118";218;318) of the jet pump (113,113',113";213;313), which is subjected to vacuum, is in fluid connection with the interior (104;204;304) of the riser pipe (102;202;302) via the first passage (114,114',114";214;314).

7. Hydrant (100) according to claim 4, wherein the first (114',114") and second (116',116") passages are oriented such that they meet within a space in the region of a wall of the hydrant (100), wherein said space is in fluid connection with the outside of the hydrant (100) via a common outlet opening.

8. Hydrant (100;200;300) according to claim 4, wherein the second passage (116,116',116";216;316) has a smaller diameter in relation to the first passage (114,114',114";214;314).

9. Hydrant (100;200;300) according to claim 4, wherein the first (114,114',114";214;314) and/or second (116,116',116";216;316) passage have a circular cross-section.

10. Hydrant (100;200) according to claim 4, wherein the first passage (114;214) has a circular cross-section with a longitudinally variable diameter, wherein the diameter in a first section tapers in the direction of flow and expands outwardly from a second section with a minimum diameter in a third section.

11. Hydrant (100;200;300) according to claim 4, wherein the ratio between a minimum inside diameter of the first passage (114,114',114";214;314) and a minimum inside diameter of the second passage (116,116',116";216;316) is 2:1 to 15:1, in particular 3:1 to 4:1, wherein the minimum inside diameter of the first passage (114,114',114";214;314) is preferably 8 mm to 10 mm and the minimum inside diameter of the second passage (116,116',116";216;316) is preferably 2 mm to 2.5 mm.

12. Hydrant (300) according to claim 4, wherein the shut-off element comprises a slide (310) configured to be moved from at least one open position to at least one closed position and vice versa by means of a drive device (311).

13. Hydrant (100;200) according to claim 4, wherein the shut-off element comprises a hydrant main valve comprising a main valve body (110;210) and a main valve seat, wherein the main valve body (110;210) is configured to be moved by means of a drive device (111;211) from at least one open position to at least one closed position and vice versa relative to the main valve seat.

14. Hydrant (200) according to claim 13, wherein the main valve seat is formed as a changeover valve seat (222) which is insertable into and removable from the hydrant (200).

15. Hydrant (200) according to claim 14, wherein the changeover valve seat (222) comprises:

a) at least one first opening (224,224',224") through which, in the drainage position of the main valve body (210) in relation to the changeover valve seat (222), the interior (104) of the riser pipe (102) is brought into fluid connection with a passage space (226), and b) the second passage (216), via which in the drainage position the hydrant inlet (206) is brought into fluid connection with the passage space (226), wherein the second passage (216) is aligned over the passage space (226) substantially axially to the first passage (214), via which the passage space (226) is brought into fluid connection with the outside of the hydrant (200).

16. Hydrant (200) according to claim 15, wherein the passage space (226) is annularly formed around the changeover valve seat (222).

17. Hydrant (200) according to claim 15, wherein the vacuum chamber (218) is formed within the passage space (226) in a region of an axial connection between the first (214) and second (216) passage.

18. Hydrant (200) according to claim 14, wherein the changeover valve seat (222) and the main valve body (210) are of cylindrical design and the main valve body (210) in the closed position is accommodated so as to be axially movable in the main valve seat in an annular manner and completely sealed with the inner surface of the changeover valve seat (222).

19. Hydrant (200) according to claim 14, wherein the changeover valve seat (222) is annular and comprises at least two grooves introduced circumferentially on the outer surface for receiving one annular seal (228',228") each, which seal the interior (204) of the riser pipe (202), the passage space (226) and the hydrant inlet (206) against one another.

20. Hydrant (200) according to claim 14, wherein the changeover valve seat (222) comprises at least one guide groove into which at least one guide cam of the hydrant (200), which corresponds in respect of size and position thereto, immerses when the changeover valve seat (222) is correctly inserted into the hydrant (200).

21. Hydrant (200) according to claim 14, wherein the changeover valve seat (222) comprises at least one guide cam which, when the changeover valve seat is correctly inserted into the hydrant (200), immerses into at least one guide groove of the hydrant (200) which corresponds to the size and position thereto.

22. Hydrant (100;200) according to claim 3, wherein the main valve body (110;210) comprises a plurality of valve wings (112',112";212',212") which are arranged to be interrupted circumferentially in relation to the main valve seat for axial guidance of the main valve body (110;210) and are brought into sealing contact with the inner surface of the main valve seat at least in the open position of the main valve.

23. Hydrant (200) according to claim 22, wherein at least one of the valve wings (212',212") is provided with a valve wing inner conduit through which the first opening (224, 224',224") is brought into fluid connection with the interior (204) of the riser pipe (202).

24. Hydrant (100;200) according to claim 13, wherein the main valve body (110;210) is provided with a main valve body inner conduit, through which the second passage (116,116,116";216;316) is brought into fluid connection with the hydrant inlet (106;206).

25. Hydrant (200) according to claim 13, wherein the main valve body (210) is reversible relative to the main valve seat by means of an adjusting device (211), wherein the hydrant main valve is designed for the purpose of releasing the flow of water through the first (214) and second (216) passages in the closed position by turning the main valve body (210) relative to the main valve seat.

26. Hydrant (200) according to claim 13, wherein the first passage (214) comprises a nozzle inserted into the hydrant body, in particular a Venturi nozzle.

27. Hydrant (100;200;300) according to claim 1, wherein the hydrant (100;200;300) further comprises at least one actuator adapted configured to release a flow of water through the first (114,114',114";214;314) and/or second (116,116',116";216;316) passage for draining the interior (104;204;304) of the riser pipe (102;202;302).

28. Hydrant (100;200;300) according to claim 27, wherein the actuator is enclosed in the shut-off element (108;208;308).

29. Hydrant (100) according to claim 27, wherein the at least one actuator comprises an electrically or mechanically controllable valve (120',120").

30. Hydrant (100;200;300) according to claim 1, designed as a surface hydrant or underground hydrant.

* * * * *